US010066895B2

(12) United States Patent
Yehle

(10) Patent No.: US 10,066,895 B2
(45) Date of Patent: Sep. 4, 2018

(54) FLEXIBLE CABLE GUARD FOR A COMPOUND ARCHERY BOW

(71) Applicant: BowTech, Inc., Eugene, OR (US)

(72) Inventor: Craig T. Yehle, Holmen, WI (US)

(73) Assignee: BOWTECH, INC., Eugene, OR (US)

( * ) Notice: Subject to any disclaimer, the term of this patent is extended or adjusted under 35 U.S.C. 154(b) by 547 days.

(21) Appl. No.: 14/454,224

(22) Filed: Aug. 7, 2014

(65) Prior Publication Data

US 2015/0027425 A1 Jan. 29, 2015

Related U.S. Application Data

(62) Division of application No. 12/581,791, filed on Oct. 19, 2009.

(51) Int. Cl.
*F41B 5/12* (2006.01)
*F41B 5/14* (2006.01)
*F41B 5/10* (2006.01)

(52) U.S. Cl.
CPC ..... *F41B 5/1403* (2013.01); *F41B 5/10* (2013.01); *F41B 5/1434* (2013.01); *Y10T 29/49826* (2015.01)

(58) Field of Classification Search
None
See application file for complete search history.

(56) References Cited

U.S. PATENT DOCUMENTS 4,542,591 A 9/1985 Montgomery
4,834,061 A 5/1989 Chattin
4,903,678 A 2/1990 Walker
5,718,213 A 2/1998 Gallops et al.
5,791,324 A 8/1998 Johnson
6,152,124 A 11/2000 Gallops
6,178,958 B1 1/2001 Gallops
6,425,385 B1 7/2002 Gallops
6,655,371 B2 12/2003 Gallops
6,904,900 B2 6/2005 Gallops
8,371,283 B2 2/2013 Grace et al.
8,424,511 B2 4/2013 Grace et al.
(Continued)

OTHER PUBLICATIONS

U.S. Appl. No. 12/581,791, filed Oct. 19, 2009, Yehle.
(Continued)

*Primary Examiner* — Melba Bumgarner
*Assistant Examiner* — Amir Klayman
(74) *Attorney, Agent, or Firm* — David S. Alavi

(57) ABSTRACT

A compound archery bow comprises a riser, limbs attached to the riser, pulley members mounted on the limbs, a draw cable, one or more additional cables, and a cable guard. The limbs, draw cable, and additional cables are arranged so that drawing the bow rotates the pulley members to let out the draw cable, takes up or lets out each additional cable with the pulley members, and bends the bow limbs toward one another. The cable guard comprises an elongated, resilient, non-articulated member attached to and extending backward from the riser, and a cable retainer. The cable guard displaces each additional cable laterally from a shooting plane of the bow sufficiently at brace to avoid fletching of an arrow, and bends inwardly when the bow is drawn but still displaces each additional cable laterally sufficiently to avoid the shaft of the arrow.

6 Claims, 4 Drawing Sheets

(56) References Cited

U.S. PATENT DOCUMENTS

| | | | | |
|---|---|---|---|---|
| 8,651,097 | B2 | 2/2014 | Grace et al. | |
| 2010/0083943 | A1* | 4/2010 | Grace et al. | 124/25.6 |
| 2010/0101549 | A1 | 4/2010 | Grace et al. | |
| 2011/0073090 | A1 | 3/2011 | McPherson | |
| 2012/0272939 | A1 | 11/2012 | Grace et al. | |

OTHER PUBLICATIONS

U.S. Appl. No. 61/102,472, filed Oct. 3, 2008, Grace et al.
U.S. Appl. No. 61/253,770, filed Oct. 21, 2009, Grace.
U.S. Appl. No. 61/292,353, filed Jan. 5, 2010, Grace et al.
U.S. Appl. No. 61/322,412, filed Apr. 9, 2010, Grace et al.
U.S. Appl. No. 61/322,415, filed Apr. 9, 2010, Grace et al.
Office action dated Aug. 9, 2012 in parent U.S. Appl. No. 12/581,791.
Office action dated Jan. 23, 2013 in parent U.S. Appl. No. 12/581,791.
Office action dated Aug. 20, 2013 in parent U.S. Appl. No. 12/581,791.
Office action dated May 2, 2014 in parent U.S. Appl. No. 12/581,791.

* cited by examiner

FLEXIBLE CABLE GUARD FOR A COMPOUND ARCHERY BOW

BENEFIT CLAIMS TO RELATED APPLICATIONS

This application is a divisional of U.S. non-provisional application Ser. No. 12/581,791 filed Oct. 19, 2009 in the name of Craig T. Yehle, said application being hereby incorporated by reference as if fully set forth herein.

BACKGROUND

The field of the present invention relates to compound archery bows. In particular, a flexible cable guard for a compound archery bow is disclosed herein.

Examples of compound archery bows with cable guards are disclosed in the following references.

U.S. Pat. No. 4,834,061 entitled "Cable vibraguard" issued May 30, 1989 to Chattin;

U.S. Pat. No. 5,718,213 entitled "Swing arm cable guard" issued Feb. 17, 1998 to Gallops et al;

U.S. Pat. No. 6,152,124 entitled "Archery bow having an incrementally adjustable cable guard" issued Nov. 28, 2000 to Gallops;

U.S. Pat. No. 6,425,385 entitled "Archery bow having a swing arm cable guard with adjustably mounted cable saver" issued Jul. 30, 2002 to Gallops;

U.S. Pat. No. 6,178,958 entitled "Archery bow having a side mounted swing arm cable guard" issued Jan. 30, 2001 to Gallops;

U.S. Pat. No. 6,655,371 entitled "Archery bow having a swing arm cable guard with adjustably mounted cable saver" issued Dec. 2, 2003 to Gallops; and U.S. Pat. No. 6,904,900 entitled "Archery bow with swing arm cable guard and fall-away arrow rest" issued Jun. 14, 2005 to Gallops.

SUMMARY

A method comprises shooting an arrow with a compound archery bow having a cable guard. The compound archery bow comprises a riser, first and second bow limbs, first and second pulley members, a draw cable, one or more additional cables, and the cable guard. The first and second bow limbs are attached to the riser, and the first and second pulley members are rotatably mounted on the first and second bow limbs, respectively. The draw cable is engaged with the first and second pulley members, and the additional cables are coupled to the first and second bow limbs. The bow limbs, the draw cable, and the additional cables are arranged so that pulling the draw cable to draw the bow causes (1) the pulley members to rotate and let out the draw cable, (2) each additional cable to be taken up or let out by at least one of the pulley members, and (3) the first and second bow limbs to bend toward one another. The cable guard comprises (1) an elongated, elastically deformable, non-articulated member attached to and extending backward from the riser, and (2) a cable retainer engaged with the elongated member and with each additional cable. The cable guard is arranged with the bow at brace to retain a central portion of each additional cable displaced laterally from a shooting plane of the bow by a first cable displacement distance D1 that is greater than or about equal to a distance F that fletching of an arrow nocked onto the draw cable extends transversely from the shooting plane toward the one or more additional cables. The cable guard is arranged with the bow drawn to bend toward the shooting plane and to retain the central portion of at least one of the one or more additional cables displaced laterally from the shooting plane by a second cable displacement distance D2 that is greater than or about equal to a distance S that a shaft of the arrow nocked onto the draw cable extends transversely from the shooting plane toward the one or more additional cables. The distance F is larger than the second cable displacement distance D2.

Objects and advantages pertaining to a cable guard for a compound archery bow may become apparent upon referring to the exemplary embodiments illustrated in the drawings and disclosed in the following written description or appended claims.

Figure 1:
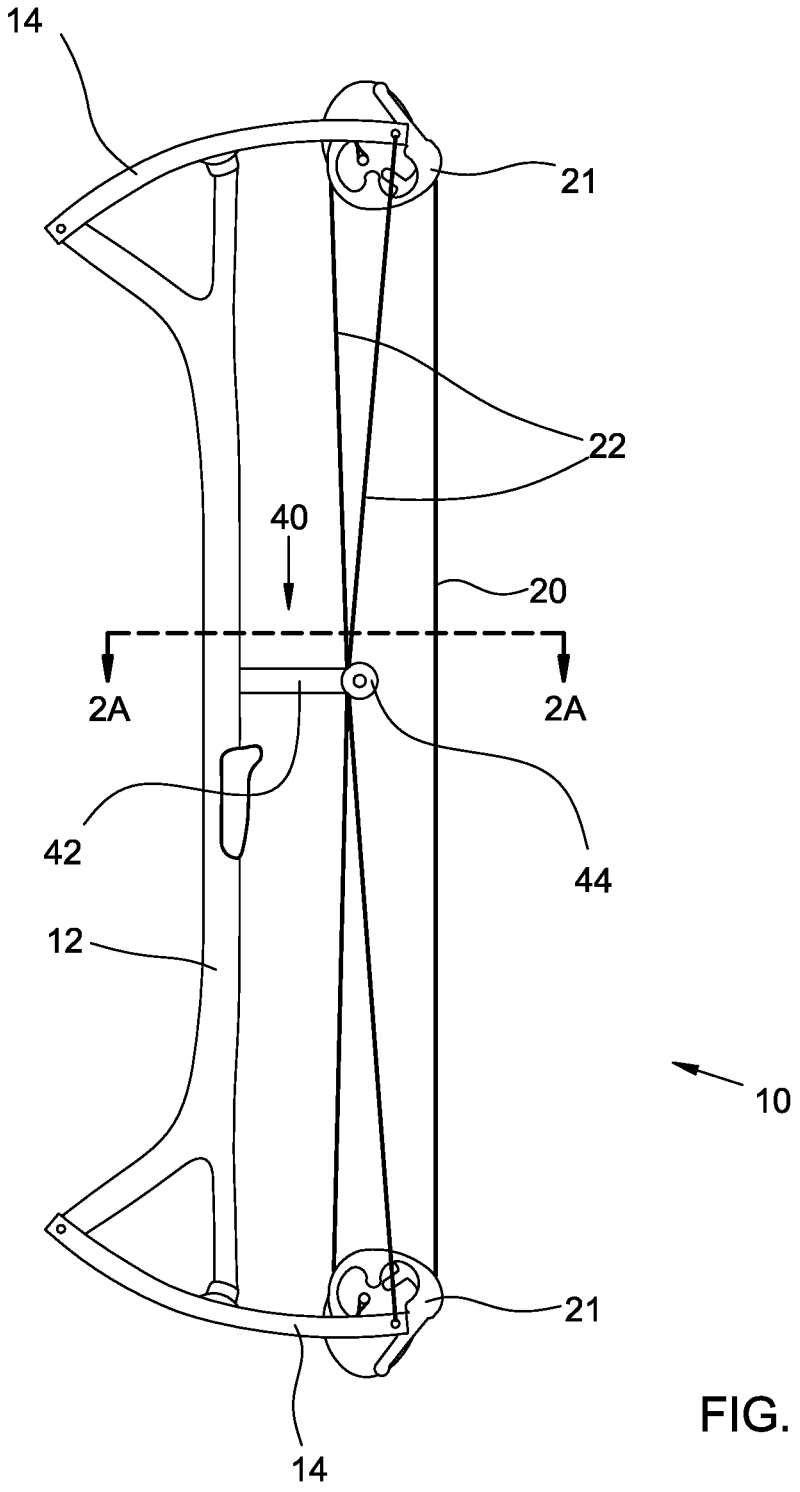
FIG. 1 is a side view of an exemplary compound archery bow with a cable guard.

The embodiments shown in the Figures are exemplary, and should not be construed as limiting the scope of the present disclosure or appended claims. Relative sizes, shapes, and proportions shown in the Figures may be distorted for clarity, and should not be considered to limit the scope of the present disclosure or appended claims.

DETAILED DESCRIPTION OF EMBODIMENTS

For purposes of the present disclosure and appended claims, the terms "compound archery bow" or "compound bow" shall denote an archery bow that uses a levering system, usually comprising one or more cables and pulleys, to bend the limbs as the bow is drawn. Compound archery bows of various types are conventional, and include pulley members rotatably mounted on the bow limbs. Those pulley members typically engage a draw cable of the bow so that pulling the draw cable to draw the bow causes the pulley members to rotate and let out the draw cable. One or more additional cables are coupled to the bow limbs, by one of the pulley members at one end, and by the other pulley member or directly to the bow limb at the other end. The additional cables are let out or taken up (according to the specific design or arrangement of a given compound bow) by the pulley members as they rotate when the bow is drawn. The pulley members typically comprise an assembly of journaled wheels or cams arranged to engage the corresponding cables, however, other suitable arrangements (e.g., a set of posts or an eccentric cable attachment) can be employed and fall within the scope of the present disclosure or appended claims.

In some compound bows (e.g., single cam or hybrid cam bows) one or more of the additional cables can be referred to as a secondary or return cable. In most compound bows, one or more of the additional cables typically is arranged as a so-called power or bus cable that serves to pull the bow limbs toward one another as the bow is drawn, the pulley members rotate, and at least one end of the power cables is taken up by a corresponding pulley member. Tension developed as the bow is drawn and one or more power cables are taken up by corresponding pulley members causes deformation of the bow limbs and storage of potential energy therein. A portion of that potential energy is transformed into the kinetic energy of the arrow shot by the bow. Examples of compound bows include dual-cam bows, bows that employ a Binary Cam System®, hybrid-cam bows, or single-cam bows. A few examples of these various compound bow types are disclosed in the following patents, all of which are incorporated by reference as if fully set forth herein:

U.S. Pat. No. 4,686,955 entitled "Compound archery bows" issued Aug. 18, 1987 to Larson, disclosing an example of a dual-cam compound bow;

U.S. Pat. No. 5,368,006 entitled "Dual-feed single-cam compound bow" issued Nov. 29, 1994 to McPherson, disclosing an example of a single-cam compound bow;

U.S. Pat. No. 6,871,643 entitled "Eccentric elements for a compound archery bow" issued Mar. 29, 2005 to Cooper et al, disclosing an example of a hybrid-cam compound bow; and U.S. Pat. No. 7,305,979 entitled "Dual-cam archery bow with simultaneous power cable take-up and let-out" issued Dec. 11, 2007 to Yehle, disclosing an example of a compound bow that employs a Binary Cam System®.

Whether dual cam, single cam, hybrid cam, or Binary Cam®, the additional cables typically are positioned between the draw cable and the riser, where they would interfere with the path of an arrow as the bow is first drawn and then shot. Accordingly, many compound bows conventionally include a rigid or articulated cable guard. Such a cable guard is typically attached to the riser and arranged to displace a central portion of each additional cable laterally from the bow's shooting plane (i.e., a plane substantially defined by the draw cable travel as the bow is drawn and then shot). If sufficiently displaced, the additional cables do not interfere with the shaft or fletching of an arrow as it is nocked, the bow is drawn, and the arrow is shot.

Conventional cable guards typically comprise a rigid or articulated member extending backward from the riser, and a cable retainer engaged with the member and with the additional cables to be laterally displaced. In some compound bows, the arrangement of the limbs and pulley members results in substantial fore-and-aft motion of the additional cables as the bow is drawn. The cable guard for such a bow must allow for that motion of the additional cables while displacing those cables laterally. A common solution is a cable block slidable along a rigid cable guard rod or other member extending backward from the riser. Another solution is to mount the cable block on an articulated arm that allows the block to move with the cables. In either case the cable block includes generally vertical holes or slots for receiving and retaining the additional cables while allowing one or more of them to slide through the holes or slots. In other compound bows there is little or no fore-and-aft motion. A cable block arrangement can be used for such bows. Alternatively, one or more journaled wheels can be rotatably mounted on a rigid cable guard member, with each laterally displaced cable engaged with a journal of one of the wheels.

While solving the problem of interference between the arrow and the additional cables as the bow is first drawn and then the arrow is shot, conventional cable guards introduce a different problem. Lateral displacement of the additional cables causes them to exert forces on the corresponding pulley members or bow limbs that are not parallel to the shooting plane; the forces exerted by those cables include a laterally directed component. The laterally directed force components can result in tilting of the pulley members (i.e., so-called cam lean), torquing or twisting of the bow limbs, or torquing or twisting of the riser. Those effects become more pronounced as the bow is drawn and the power cables in particular experience greater tension. Any one or more of those effects can result in undesirable wear or fatigue of the bow or its parts, or can result in degraded velocity or accuracy of the bow. It is desirable to reduce the lateral force components exerted by the laterally displaced cables. This can be accomplished by reducing the lateral displacement, but at brace the lateral displacement of the cables preferably would still enable passage of the shot arrow substantially without interference between the displaced cables and the arrow's fletching.

However, that amount of displacement is only needed when the fletching passes by the additional cables. As the bow is drawn and during the early portion of its flight (before the fletching passes the additional cables), the additional cables need only be displaced enough to clear the shaft of the arrow. Reduced lateral displacement in turn reduces the lateral force components exerted by the cables. Such reduced lateral displacement of the cables has been achieved previously by employing an articulated cable guard with its articulation axis tilted slightly, as disclosed in U.S. Pat. No. 5,718,213.

Reduced lateral force components are achieved in a compound bow according to the present disclosure and appended claims. Exemplary compound bows 10 are illustrated schematically in FIGS. 1 and 3, and each comprises a riser 12, bow limbs 14 attached to the riser 10, and pulley members 21 rotatably mounted on the limbs 14. A draw cable 20 is engaged with the pulley members 21. In the exemplary bows 10 (which are each both arranged as dual-cam bows), the additional cables are power cables 22 coupled at each end to the bow limbs 14. As is typically the case for a dual-cam bow, each power cable 22 is connected directly at one end to the corresponding bow limb 14, and engaged at the other end to be taken up by the corresponding pulley member 21. The bow limbs 14, the draw cable 20, and the power cables 22 are arranged so that pulling the draw cable 20 to draw the bow causes (1) the pulley members 21 to rotate and let out the draw cable 20, (2) each power cable 22 to be taken up by a corresponding one of the pulley members 14, and (3) the first and second bow limbs 14 to bend toward one another.

Figure 3:
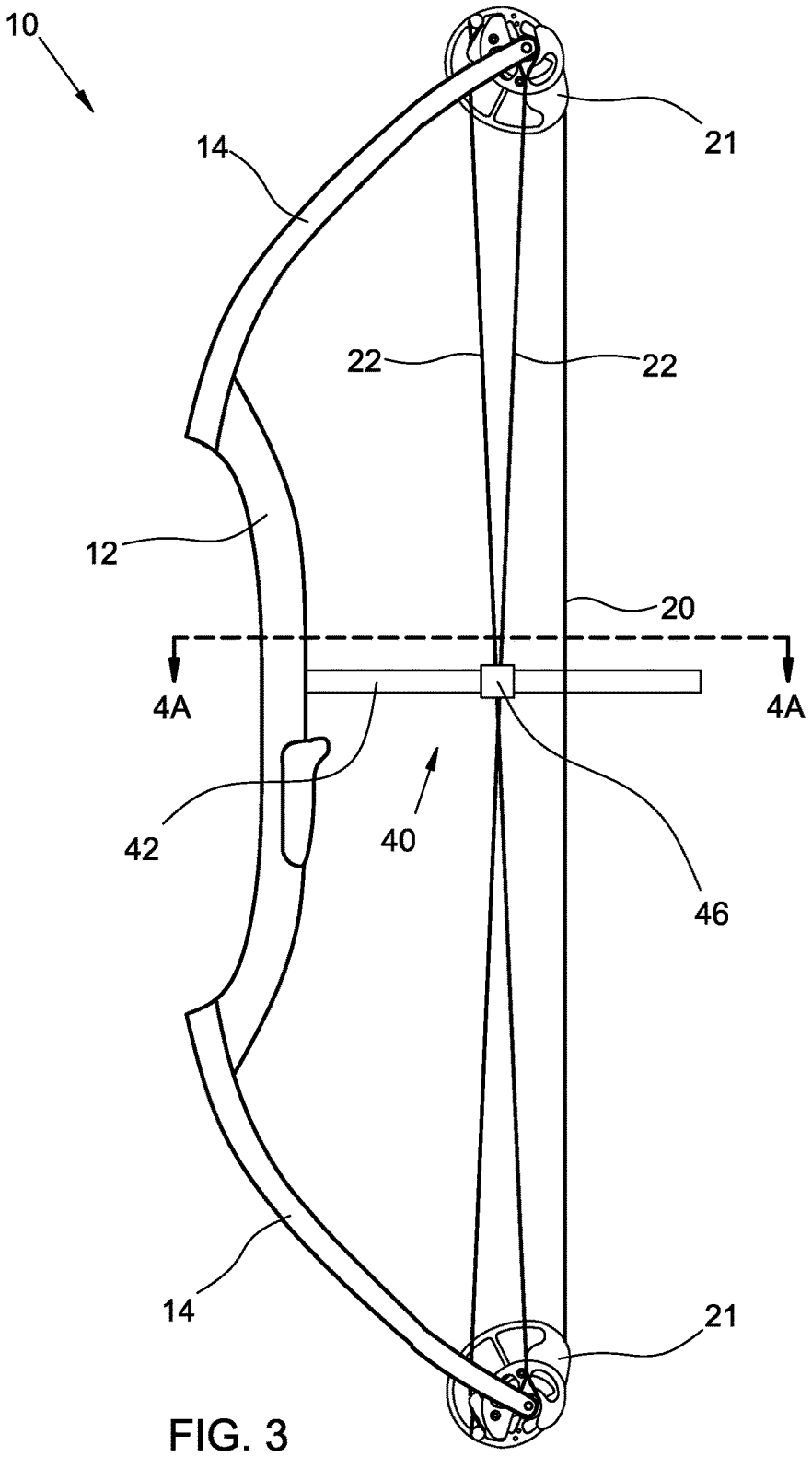
FIG. 3 is a side view of another exemplary compound archery bow with a cable guard.

The exemplary bows 10 of FIGS. 1 and 3 are both arranged as dual-cam compound bows, with the additional cables being power cables 22. However, a cable guard as disclosed and claimed herein can be employed with any suitable compound bow (e.g., dual-cam, single-cam, hybrid cam, or Binary Cam®) to laterally displace additional cables of any suitable type (e.g., power cable, bus cable, return cable, or secondary cable).

Figure 2A:
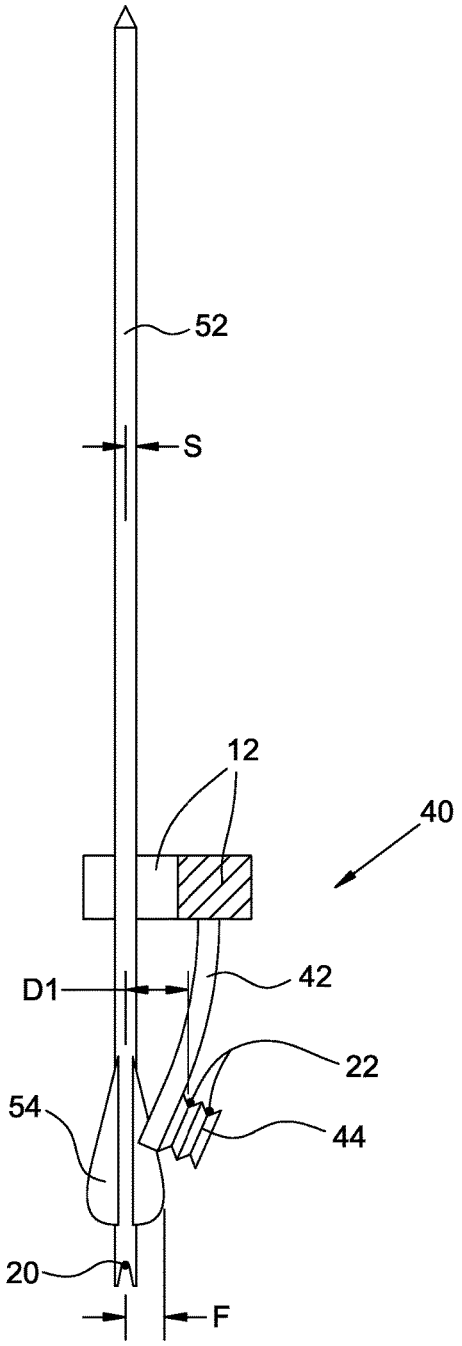
FIGS. 2A and 2B are partial top cross-sectional views of the exemplary bow of FIG. 1 and an arrow at brace and drawn, respectively, with the distances D1, D2, F, and S labeled.
Figure 2B:
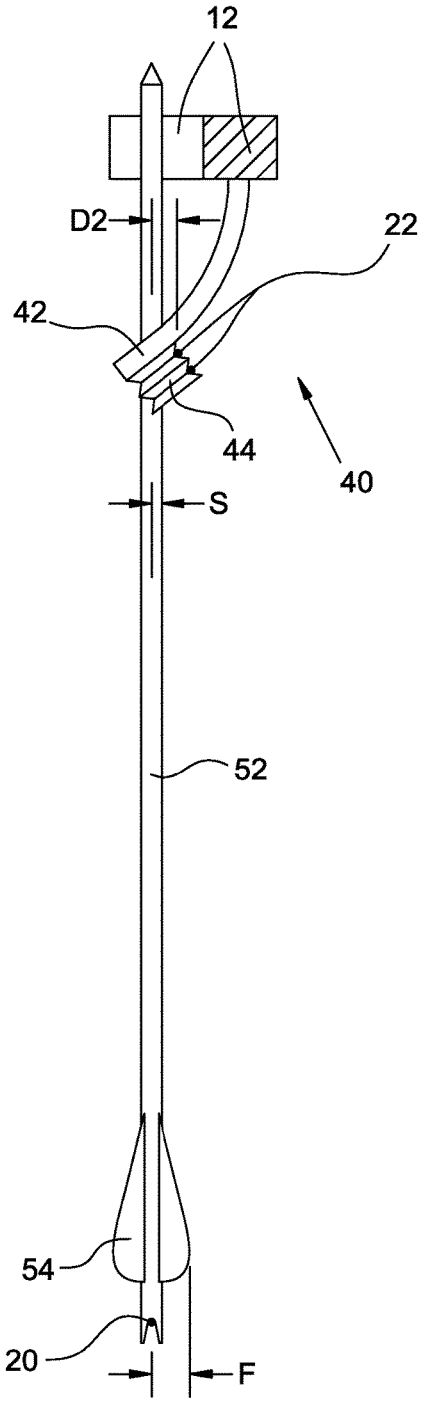

Each of the exemplary bows 10 includes a cable guard 40 attached to the riser 12 and arranged to displace laterally the power cables 22. In the exemplary bow of FIG. 1, the cable guard 40 comprises (1) an elongated, resilient (i.e., elastically deformable), non-articulated member 42 attached to and extending backward from the riser 12, and (2) a pair of journaled wheels 44 rotatably mounted on the member 42 that act as a cable retainer (a smaller or larger number of such wheels can be employed as needed or desired). FIGS. 2A and 2B are partial top cross-sectional views of the exemplary bow of FIG. 1. FIGS. 2A and 2B include an arrow and depict the bow of FIG. 1 at brace and drawn, respectively. A non-articulated attachment can connect the member 42 to the riser 12, substantially rigidly connecting the member 42 to riser 12 while allowing the backwardly extended portion of the member 42 to bend laterally. Alternatively, a flexible, pivotable, or articulated attachment can be employed if tension exerted by the cables 22 can be relied on to hold the cable guard 40 in place (see below). The member 42 can comprise a single, integrally formed, resilient member. Alternatively, member 42 can comprise multiple parts connected to form a member lacking any articulated joint (e.g., lacking any hinge, pivot, axle, or similar structure that forms a bending joint between adjacent segment of the member 42) but capable of elastic deformation as a whole.

As shown in FIG. 2A, at brace the cable guard 40 is arranged to retain a central portion of each power cable 22 displaced laterally from the shooting plane by a first cable displacement distance D1. The member 42 and cable retainer 44 are arranged so that, with the bow 10 at brace, the lateral component of the tension in cables 22 bends the member 42 medially toward the shooting plane, and the resulting elastic strain in the bent member 42 pulls the cables 22 laterally by the distance D1. The distance D1 also partly determines the lateral component of the cable tension; that lateral component varies approximately proportionally with the distance D1 for the typically small angular displacement of the cables 22 relative to the shooting plane (typically less than about 5°, and less than about 3° for most compound bows). The strength and stiffness of the member 42, the position of cable retainer 44 along member 42, and the position of cable guard 40 on the bow 10 are preferably chosen according to known methods so that the tension of the cables 22 (with the bow 10 at brace) results in a suitable amount of bend strain of member 42 and the desired lateral cable displacement D1. D1 can be chosen to be equal to or only slightly larger than the minimum displacement needed to avoid interference between the cables 22 and the fletching 54 of the arrow (i.e., greater than or about equal to the distance F that fletching of an arrow nocked onto the draw cable extends transversely from the shooting plane toward the cables 22), to avoid unnecessarily large lateral force components exerted by the cables 22. Slightly smaller displacement D1 can be employed that might allow only negligible interference between the cables 22 and the fletching 54.

As shown in FIG. 2B, when the bow 10 is drawn the tension in cables 22 increases and further bends the member 42 medially toward the shooting plane, allowing the cables 22 to move medially as well. With the bow 10 drawn, the cables 22 are displaced laterally from the shooting plane by a distance D2<D1. The distance D2 is sufficient to enable the arrow shot by the bow 10 to pass the power cables 22 substantially without interference between the power cables 22 and the shaft 52 of the arrow (i.e., the distance D2 is greater than or about equal to the distance S that the shaft of the arrow nocked onto the draw cable extends transversely from the shooting plane toward the one or more additional cables). The smaller displacement D2 partly offsets the increased tension of the cables 22, but there is still a net increase in the lateral component of the cable tension that is exerted on cable guard 40. The member 42 bends further inward toward the shooting plane until the increased elastic strain in member 42 balances the increased lateral component of the cable tension. As described above, the stiffness of the member 42, the position of cable retainer 44 along member 42, and the position of cable guard 40 on the bow 10 are preferably chosen according to known methods so that the tension of the cables 22 (with the bow 10 drawn) result in a suitable amount of bend strain of member 42 and the desired distance D2. When the draw cable 20 is released to shoot the arrow, the cable guard returns to the arrangement shown in FIG. 2A.

Figure 4A:
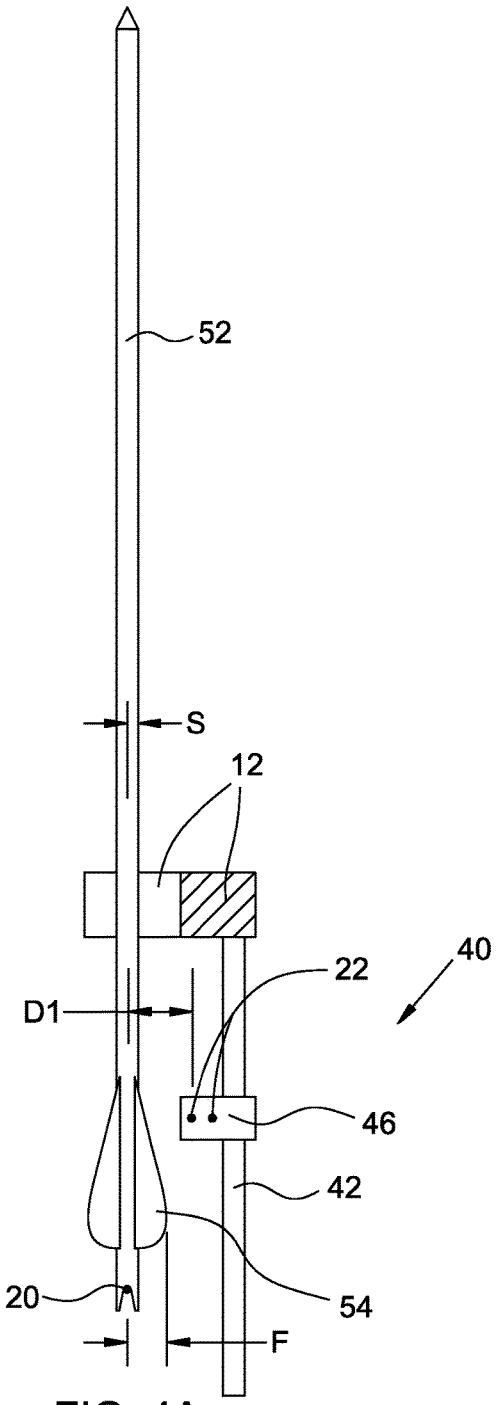
FIGS. 4A and 4B are partial top cross-sectional views of the exemplary bow of FIG. 3 and an arrow at brace and drawn, respectively, with the distances D1, D2, F, and S labeled.
Figure 4B:
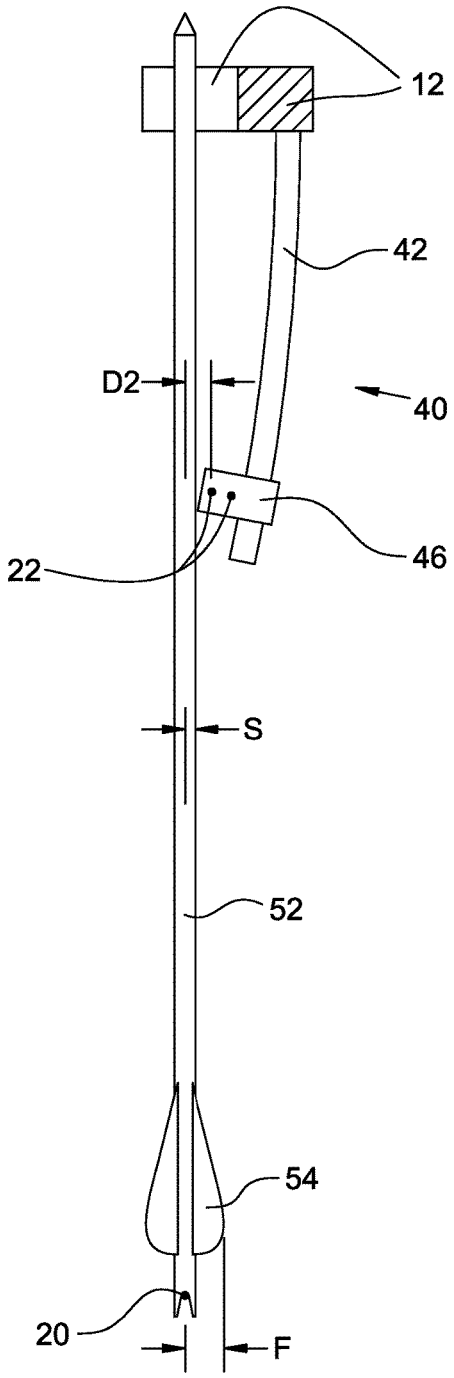

In the exemplary bow of FIG. 3, the cable guard 40 comprises (1) an elongated, resilient, non-articulated member 42 attached to and extending backward from the riser 12, and (2) a cable block 46 slidably mounted on the elongated member that acts as a cable retainer. FIGS. 4A and 4B are partial top cross-sectional views of the exemplary bow of FIG. 3. Each power cable 22 is received through and slidable through a corresponding hole or slot in the cable block 46 (holes are depicted in FIGS. 4A and 4B). FIGS. 4A and 4B include an arrow and depict the bow of FIG. 3 at brace and drawn, respectively. The construction and attachment of member 42 can be substantially as described above for FIGS. 1, 2A, and 2B.

Likewise, the displacement of the cables 22 by the member 42 and the cable block 46 as the bow 10 of FIGS. 3, 4A, and 4B is drawn occurs substantially as described above for the bow 10 of FIGS. 1, 2A, and 2B, with the addition of sliding motion of cable block 46 along the member 42 to accommodate fore-and-aft movement of the cables 22 as the bow 10 is drawn and then shot. The elastic strain on the member 42 with the bow 10 at brace is sufficient to displace laterally the cables 22 sufficiently to substantially avoid interference between the cables 22 and fletching 54. Increased elastic strain on member 42 (arising from increased tension of cables 22 when the bow 10 is drawn) allows the cable block 46 and the displaced cables 22 to move toward the shooting plane but to still avoid interference between the cables 22 and the shaft 52. Increased bending of member 42 results in decreased lateral tension components, relative to those that would occur with a rigid cable guard.

Any suitably strong and resilient material can be used to form member 42, e.g., fiberglass or other composite, plastic or polymer, wood, or metal or alloy (such as spring steel). An elastic modulus of a suitable material for member 42 typically can be less than about 10 Mpsi (1 Mpsi≡$10^6$ pounds per square inch), preferably between about 2 Mpsi and about 7 Mpsi. In a particular example, fiberglass is employed having a modulus of about 5.6 Mpsi.

Member 42 can have any suitable cross sectional shape (e.g., circular, elliptical, oval, square, rectangular, or polygonal). It can be advantageous to employ a cross sectional shape for member 42 that is larger in a transverse dimension parallel to the shooting plane than in the orthogonal transverse dimension, to allow bending of member 42 toward the shooting plane while hindering bending toward one or the other of the bow limbs. For the exemplary cable guard of FIGS. 1, 2A, and 2B the cross sectional size or shape can remain constant along the length of member 42 or can vary along that length as needed or desired. For the exemplary cable guard of FIGS. 3, 4A, and 4B the cross section size and shape is preferably constant over that portion of the length of member 42 along which cable block 46 slides.

Any suitable distances can be chosen for D1 and D2 that eliminate interference between any additional cables 22 and the fletching 54 or shaft 52, respectively, of an arrow (or reduce that interference to a substantially negligible level). D1 or D2 might typically be made as small as practicable for fletching and shaft sizes of arrows typically shot with a given bow. In some embodiments, the second cable displacement distance D2 is insufficient to enable an arrow shot by the bow to pass each additional cable substantially without interference between fletching of the arrow and the additional cables 22 (if the cables 22 were to remain at the distance D2 when the arrow is shot, which of course they do not); in other words, in some examples the distance D2 is less than the distance F. However, even if D2<F, the fletching 54 clears the additional cables 22 and the arrow can be shot by the bow because the cable guard returns to its brace position when the bow is shot (as noted above). D1 can typically range between about 0.5 inches and about 1.0 inches, preferably between about 0.65 and about 0.85 inches. D2 can typically range between about 0.2 inches and about 0.9 inches, preferably between about 0.4 inches and about 0.6 inches. In one particular example, D1 is about 0.75 inches and D2 is about 0.5 inches.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

In the appended claims, if the provisions of 35 USC § 112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112 ¶ 6 are not intended to be invoked for that claim.

What is claimed is:

1. A method comprising:

(i) nocking an arrow onto a draw cable of a compound archery bow at brace, wherein the compound archery bow comprises:

(a) a riser and first and second bow limbs attached to the riser, (b) first and second pulley members rotatably mounted on the first and second bow limbs, respectively, (c) the draw cable engaged with the first and second pulley members, (d) one or more additional cables coupled to the first and second bow limbs, and (e) a cable guard comprising (1) an elongated, resilient, non-articulated member attached to and extending backward from the riser, and (2) a cable retainer engaged with the elongated member and with each additional cable, wherein the cable guard is arranged with the bow at brace to retain a central portion of each additional cable displaced laterally from a shooting plane of the bow by a first cable displacement distance D1 that is greater than or about equal to a distance F that fletching of an arrow nocked onto the draw cable extends transversely from the shooting plane toward the one or more additional cables;

(ii) pulling the draw cable to draw the bow with the nocked arrow, wherein:

(a) the bow limbs, the draw cable, and the additional cables are arranged so that pulling the draw cable to draw the bow causes (1) the pulley members to rotate and let out the draw cable, (2) each additional cable to be taken up or let out by at least one of the pulley members, and (3) the first and second bow limbs to bend toward one another, (b) the cable guard is arranged so that pulling the draw cable to draw the bow causes the cable guard to bend toward the shooting plane in response to tension in at least one of the one or more additional cables and, with the bow drawn, to retain the central portion of at least one of the one or more additional cables displaced laterally from the shooting plane by a second cable displacement distance D2, (c) the second cable displacement distance D2 is greater than or about equal to a distance S that a shaft of the arrow nocked onto the draw cable extends transversely from the shooting plane toward the one or more additional cables, and (d) the second cable displacement distance D2 is less than the distance F; and (iii) releasing the draw cable to shoot the arrow.

2. The method of claim 1 wherein the first cable displacement distance D1 is between about 0.5 inches and about 1.0 inches and the second cable displacement distance D2 is between about 0.2 inches and about 0.9 inches.

3. The method of claim 1 wherein the cable retainer comprises one or more journaled wheels rotatably mounted on the elongated member, and each additional cable is engaged with a journal of one of the wheels.

4. The method of claim 1 wherein the cable retainer comprises a cable block slidably mounted on the elongated member, and each additional cable is received through and slidable through a corresponding hole or slot in the cable block.

5. The method of claim 1 wherein the elongated member comprises metal, alloy, polymer, plastic, or composite material.

6. The method of claim 1 wherein the elongated member comprises a material having an elastic modulus less than about 10 Mpsi.

* * * * *